US006971561B2

(12) United States Patent
Sawlewicz

(10) Patent No.: US 6,971,561 B2
(45) Date of Patent: Dec. 6, 2005

(54) AUXILIARY DEVICE FOR PUTTING ON THERAPEUTIC COMPRESSION GARMENTS, ESPECIALLY TIGHTS, KNEE-LENGTH SOCKS AND FULL-LENGTH STOCKINGS

(76) Inventor: Pawel Sawlewicz, Ul. Dywizjonu 303 nr 5E 13, PL-80-462 Gdańsk (PL)

( * ) Notice: Subject to any disclaimer, the term of this patent is extended or adjusted under 35 U.S.C. 154(b) by 49 days.

(21) Appl. No.: 10/807,480

(22) Filed: Mar. 23, 2004

(65) Prior Publication Data

US 2004/0178234 A1 Sep. 16, 2004

Related U.S. Application Data

(62) Division of application No. 09/623,650, filed as application No. PCT/PL99/00005 on Mar. 1, 1999, now abandoned.

(51) Int. Cl.[7] ..... A47G 25/90
(52) U.S. Cl. ..... 223/111; 223/112

(58) Field of Search ..... 223/111, 112, 113, 223/118, 119, 1; 2/49.2

(56) References Cited

U.S. PATENT DOCUMENTS

| | | | | | |
|---|---|---|---|---|---|
| 4,072,255 | A * | 2/1978 | Bogorad | 223/111 |
| 4,260,083 | A * | 4/1981 | Aslin | 223/111 |
| 4,599,812 | A * | 7/1986 | Harmsen | 36/1.5 |
| 5,356,057 | A * | 10/1994 | Vossen | 223/112 |
| 5,673,826 | A * | 10/1997 | Stolk | 223/112 |
| 5,924,609 | A * | 7/1999 | Stolk et al. | 223/112 |
| 6,219,846 | B1 * | 4/2001 | Toole | 2/49.2 |

* cited by examiner

*Primary Examiner*—Bibhu Mohanty
(74) *Attorney, Agent, or Firm*—Bryan Cave LLP

(57) ABSTRACT

The device is made from low friction factor fabric, has the shape of a plane figure with a catch element (1) at its one end beneficially in the form of a pocket, and at its other end there is a fastening element (2) in the form of a tape, press stud or some other well-known fasteners.

18 Claims, 1 Drawing Sheet

AUXILIARY DEVICE FOR PUTTING ON THERAPEUTIC COMPRESSION GARMENTS, ESPECIALLY TIGHTS, KNEE-LENGTH SOCKS AND FULL-LENGTH STOCKINGS

This application is a divisional of U.S. Application Ser. No. 09/623,650 filed Sep. 6, 2000 now abandoned, which is the National Stage of International Application No. PCT/PL99/00005 filed Mar. 1, 1999.

The subject of the invention presented is an auxiliary device for putting on therapeutic compression garments, especially tights, knee-length socks and fulllength stockings; particularly ones with a closed toe-tip.

A device helping to put on therapeutic compression garments with an open toe-tip is known. It looks like a sock made from low friction factor fabric. Such a device is put on a leg, then a therapeutic compression garment, e.g. a socking, is pulled up over it, and finally the device is pulled off the leg through the hole in the toepart of the stocking. The purpose of using the device is to lower the friction which is present between the skin and the stocking material, while the compression stocking is being pulled up the leg. Such an existing device can be used only to help put on therapeutic compression garments with an open toe-tip, since only then can it be taken off the leg.

The invention presented is an auxiliary device for putting on therapeutic compression garments, especially tights, knee-length socks and full-length stockings. It is made from low friction factor fabric and its characteristic feature is its shape, i.e. of a plane figure with a beneficial catch element in the form of a pocket at its one end; at the opposite end, beneficially, there is a fastening element in the form of a tape, press stud or some other well-known fasteners.

In the variant of the invention execution, the pocket has a press stud or Velcro ®.

Owing to its construction, the device according to the invention makes putting on a therapeutic compression garment easy and painless, even when it is the type with a closed toe-tip.

The device according to the invention is depicted in the illustration, where:

FIG. 1 presents its schematic view;

EXAMPLE I

Figure 1:
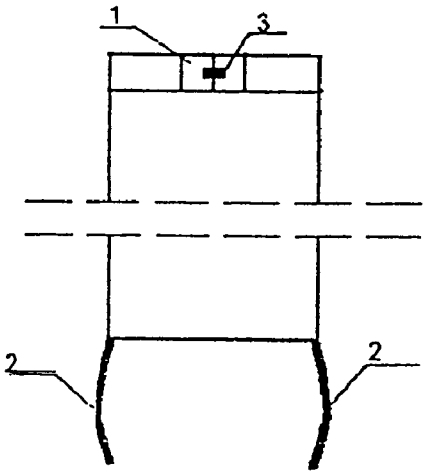
Figure 2:
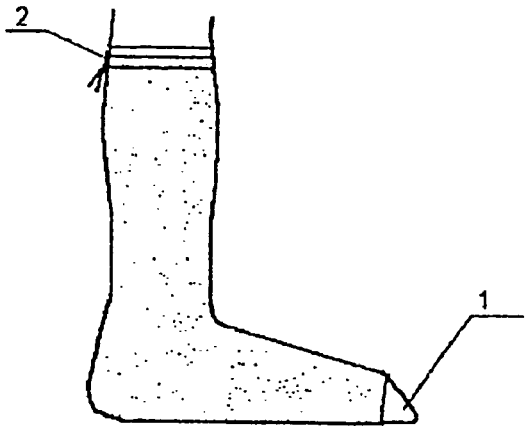
FIG. 2 shows the device after it has been put on a leg.
Figure 3:
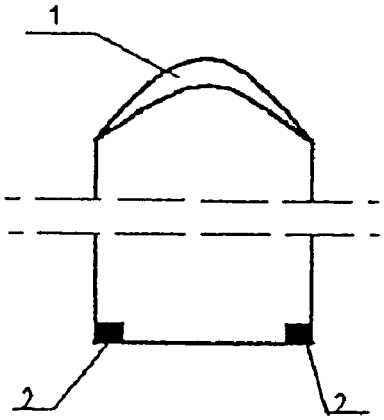
FIG. 3 shows the view of another version of the device.

The device is made from material which is smooth on its both sides and of low friction factor of its surface. The device is rectangular in shape and is 60 centimeters long and 40 centimeters wide. At one end of the device there is a pocket 1, which is 2 centimeters deep. At the opposite end, there is a tape 2 attached. The device is used in the following manner: The toes are inserted into the pocket 1, the cloth of the device is put around the leg so that it covers the whole of the leg surface smoothly, possibly without any folds or wrinkles. The top part of the device is attached to the leg with the tape 2 by tying it around the leg. Once that is done, a compression stocking is pulled up on the leg in a usual way. Then, by using a hand, (through the stocking) the toes are freed from the pocket 1, the tape 2 is undone, and having been pulled by its top the device is removed from under the stocking.

EXAMPLE II

The device is made just like in Example I, but the pocket 1 is closed with a fastener 3 in the form of Velcro®. At the opposite end of the device there is a tape 2. The device is used in the following manner: The toes are inserted into the pocket 1, the cloth of the device is put around the leg so that it covers the whole of the leg surface smoothly, possibly without any folds or wrinkles. The top part of the device is attached to the leg with the tape 2 by tying it around the leg. Once that is done, a compression stocking is pulled up on the leg in a usual way.

Then, the tape 2 is undone, and when the device is energetically pulled at the top, the Velcro® becomes undone thus freeing the toes from the pocket, and finally the device can be removed from under the stocking by being pulled by its top.

EXAMPLE III

The device is made from material which is smooth on its both sides and of low friction factor of its surface. Its pocket 1 is adjusted to the shape of toes. When the device is put on the leg, its shape resembles that of a knee-length sock. There is a fastener 2 at the other end of the device. The device is used in the following manner: After the device has been put on the leg, its top edges are joined with the fastener 2 so that the device will not slide down the leg. Once that is done, a compression stocking is pulled up on the leg in a usual way. Then the fastener 2 is undone, and by using a hand (through the stocking) the toes are freed from the device, which having been pulled by its top, is removed from under the stocking.

What is claimed is:

1. A method of putting on a compression garment comprising:

a) providing a device comprising an essentially flat sheet of smooth, low-friction fabric having two opposing ends, a catch element adjacent to the first end of the flat sheet, and a fastening means adjacent to the second end of the flat sheet;

b) securing a tip of a limb to the device with the catch element;

c) covering the surface of the limb adjacent to the tip with the flat sheet;

d) securing the second end of the flat sheet to or around the limb with the fastening means;

e) pulling a compression garment onto the limb over the device; and f) removing the device from the limb while leaving the compression garment in place on the limb.

2. A method according to claim 1, wherein the catch element is a pocket with an opening facing the second end of the flat sheet and the tip of the limb is secured to the device by inserting the tip of the limb into the pocket.

3. A method according to claim 1, wherein the fastening means is selected from the group consisting of a tie, tape, a press stud, and a hook-and-loop type fastener.

4. A method according to claim 1, wherein the compression garment has a closed toe.

5. A method according to claim 4, wherein the compression garment is a tight, a knee-length sock, or a full-length stocking.

6. A method according to claim 1, wherein the limb is a leg and the tip of the limb is the toes.

7. A method according to claim 1, wherein the flat sheet is in the shape of a rectangle.

8. A method according to claim 7, wherein the flat sheet is about 40 cm in width and about 60 cm in length, and the catch element and the fastening means are on opposite ends of the length of the sheet.

9. A method according to claim 2, wherein the pocket is about 2 cm deep.

10. A method of putting on a compression garment comprising:

a) providing a device comprising an essentially flat sheet of smooth, low-friction fabric having two opposing ends and a pocket adjacent to the first end of the flat sheet formed by folding the flat sheet onto itself and securing with a fastener and a fastening means adjacent to the second end of the flat sheet;

b) inserting a tip of a limb into the pocket;

c) covering the surface of the limb adjacent to the tip with the flat sheet;

d) securing the second end of the flat sheet to or around the limb with the fastening means;

e) pulling a compression garment onto the limb over the device;

f) releasing the second end of the flat sheet from the limb;

g) pulling the device by the second end thereby disengaging the fastener, collapsing the pocket, and releasing the tip of the limb; and h) removing the device from the limb while leaving the compression garment in place on the limb.

11. A method according to claim 10 wherein the fastener is of a hook-and-loop type or a press stud type.

12. A method according to claim 10, wherein the fastening means is selected from the group consisting of a tie, tape, a press stud, and a hook-and-loop type fastener.

13. A method according to claim 10, wherein the compression garment has a closed toe.

14. A method according to claim 13, wherein the compression garment is a tight, a knee-length sock, or a full-length stocking.

15. A method according to claim 10, wherein the limb is a leg and the tip of the limb is the toes.

16. A method according to claim 10, wherein the flat sheet is in the shape of a rectangle.

17. A method according to claim 16, wherein the flat sheet is about 40 cm in width and about 60 cm in length, and the pocket and the fastening means are on opposite ends of the length of the sheet.

18. A method according to claim 10, wherein the pocket is about 2 cm deep.

* * * * *